US005754145A

United States Patent [19]

Evans

[11] Patent Number: 5,754,145

[45] Date of Patent: May 19, 1998

[54] PRINTED ANTENNA

[75] Inventor: David H. Evans, Crawley, England

[73] Assignee: U.S. Philips Corporation, New York, N.Y.

[21] Appl. No.: 681,645

[22] Filed: Jul. 29, 1996

[30] Foreign Application Priority Data

Aug. 23, 1995 [GB] United Kingdom ..... 9517241

[51] Int. Cl.[6] ..... H01Q 9/28

[52] U.S. Cl. ..... 343/795; 343/727; 343/794

[58] Field of Search ..... 343/700 MS, 793, 343/795, 846, 853, 725, 727, 730, 794

[56] References Cited

U.S. PATENT DOCUMENTS

| | | | |
|---|---|---|---|
| 3,208,069 | 9/1965 | Brueckmann | 343/712 |
| 4,686,536 | 8/1987 | Allcock | 343/700 MS |
| 4,814,783 | 3/1989 | Shelton et al. | 343/795 |
| 4,825,220 | 4/1989 | Edward et al. | 343/795 |
| 5,387,919 | 2/1995 | Lam et al. | 343/821 |
| 5,495,260 | 2/1996 | Couture | 343/700 MS |
| 5,598,174 | 1/1997 | Erkocevic et al. | 343/795 |

*Primary Examiner*—Donald T. Hajec
*Assistant Examiner*—Tan Ho
*Attorney, Agent, or Firm*—Robert J. Kraus

[57] ABSTRACT

A printed antenna comprises an end fed elongate first dipole element (12) provided on one side of a dielectric substate (10). A second dipole element (16, 17) is provided on the opposite side of the dielectric substrate. The second dipole comprises first and second elongate elements (16, 17) disposed one on each side of the longitudinal axis of the first dipole element as viewed through the substrate. A ground plane (14) on the second side of the substrate is connected to the first and second elements (16, 17) at a distance from a free end of the first dipole element corresponding substantially to a quarter wavelength of the frequency (or centre frequency) above interest. The first and second elements (16, 17) are a quarter of a wavelength long and may be inclined relative to the first dipole element (12) or extend parallel thereto (4 (not shown)). Pairs of the printed antennas may be connected with switching elements to form antenna diversity arrangements.

12 Claims, 4 Drawing Sheets

PRINTED ANTENNA

BACKGROUND OF THE INVENTION

1. Field of the Invention

The present invention relates to a printed antenna which is suitable for incorporating into the housing of a receiver and/or transmitting apparatus. The present invention also relates to an antenna diversity arrangement comprising a pair of printed antennas and means to short circuit either one of the first and second antennas and to a transceiver comprising the printed antenna or the combination of the first and second printed antennas.

2. Description of the Related Art

U.S. Pat. No. 5,387,919 discloses a printed circuit antenna comprising an electrically insulating substrate on opposite sides of which are oppositely directed U-shaped, quarter wave, metallic radiators disposed symmetrically about a common longitudinal axis. The bases of the U-shaped radiators overlie each other and are respectively coupled to balanced transmission line conductors to one end of which a coaxial cable is connected, the other end being connected to a balun. By arranging the balun, coaxial cable and the balance conductors along the axis of the radiators, they do not interfere with the radiation pattern from the radiators. The requirement to use a balun limits the usage of the printed antenna because the antenna itself cannot be coupled directly to an input circuit of a receiver and/or output circuit of a transmitter.

SUMMARY OF THE INVENTION

An object of the present invention is to increase the range of application of printed antennas.

According to one aspect of the present invention there is provided a printed antenna comprising an end fed elongate first dipole element provided on one side of a dielectric substrate, a second dipole element provided on a second side of the dielectric substrate, the second dipole comprising first and second elongate elements disposed one on each side of the longitudinal axis of the first dipole element as viewed through the substrate and a ground plane coextensive with a feed portion of the first dipole element, said ground plane being connected to the first and second elements.

If desired the first and second elements may extend parallel to or be inclined relative to the longitudinal axis of the first dipole element as viewed perpendicular to the plane of the substrate. An angle of inclination of between 10 and 45 degrees, for example 30 degrees, to the longitudinal axis of the first dipole element has been found to give an effective performance.

According to a second aspect of the present invention there is provided the combination of first and second parallel arranged printed antennas and switching means for shorting out a predetermined one of said first and second antennas, wherein each of said first and second antennas comprises an end fed elongate first dipole element provided on one side of a dielectric substrate, a second dipole element provided on a second side of the dielectric substrate, the second dipole comprising first and second elongate elements disposed one on each side of the longitudinal axis of the first dipole element as viewed through the substrate and a ground plane coextensive with a feed portion of the first dipole element, said ground plane being connected to the first and second elements.

The first dipole elements of the first and second printed antennas may be separated by a distance of between substantially quarter and half a wavelength of the frequency or centre frequency of interest. The switching means may comprise PIN diodes operated by an antenna diversity means.

The printed antenna made in accordance with the present invention is low cost, omni-directional, compact, able to be integrated with the fabrication of the transmitter and receiver circuits and is end fed thereby avoiding the need for a balun.

According to a third aspect of the present invention there is provided a transceiver comprising a transmitter having an output, a receiver having an input, a printed antenna in accordance with the invention and means coupling said output and input to said printed antenna.

According to a fourth aspect of the present invention there is provided a transceiver comprising a transmitter having an output, a receiver having an input, the combination of first and second printed antennas made in accordance with the present invention, means coupling said output and input to said first and second printed antennas and means for actuating said switching means.

BRIEF DESCRIPTION OF THE DRAWINGS

The present invention will now be described, by way of example, with reference to the accompanying drawings, wherein.

In the drawings the same reference numerals have been used to indicate corresponding features.

DESCRIPTION OF THE PREFERRED EMBODIMENTS

Figure 1:
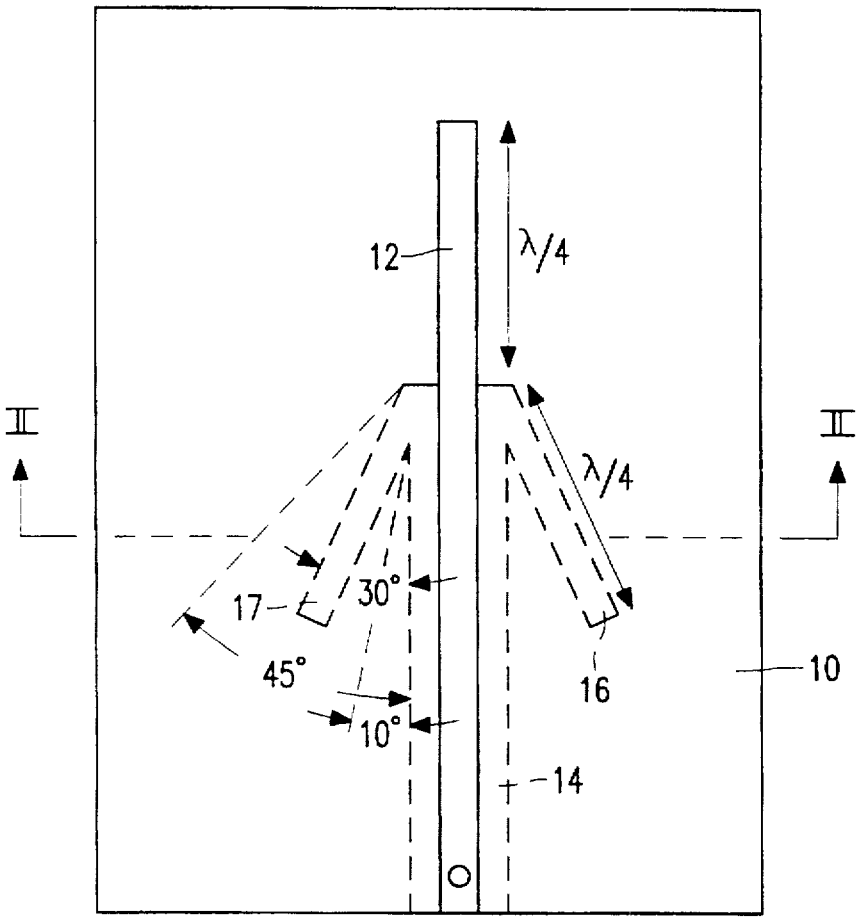
FIG. 1 is a diagrammatic illustration of a first embodiment of the printed antenna having a drooping wire dipole.
Figure 2:
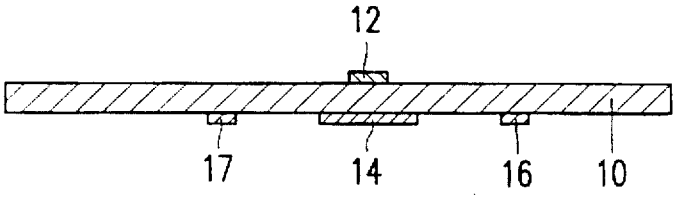
FIG. 2 is a cross-section on the line II—II of FIG. 1.

Referring to FIGS. 1 and 2 the printed antenna comprises a substrate 10 of for example Duroid or FR 4 glass fibre. On one side of the substrate 10 is provided a first elongate end-fed metallic dipole 12. In use it is intended that the dipole be arranged vertically such that the effective part of the dipole is the upper section having a length corresponding substantially to a quarter wavelength of the frequency (or centre frequency) of interest. The elongate dipole is formed in microstrip.

On the reverse side of the substrate 10, also formed in microstrip, is a ground plane and a second dipole comprising first and second elements 16, 17 in microstrip which are connected to the ground plane 14 at a distance corresponding to substantially to a quarter of a wavelength from the free end of the first dipole element and extend away therefrom. Each of the first and second elements 16, 17 has a length corresponding to a quarter wavelength of the frequency (or centre frequency) of interest. The first and second elements 16, 17 are inclined relative to the longitudinal axis of the first dipole element and for practical considerations the preferred range of angles is from 10° to 45°, with 30° having been found to provide good results when operating at 6 GHz. From an RF point of view the first dipole element 12 and the first and second elements 16, 17 form a half wave antenna with the electrical junction between the two dipoles being at a low impedance, that is an impedance which is matched to the feed line impedance, typically 50 ohms. The width of the ground plane 14 is reduced so that the feed can reach the central feed point at the point of convergence of the first and second elements 16, 17. Reducing the ground plane width has a small effect on the impedance of the microstrip. The impedance can be returned to its correct value by varying the width of the elongate first dipole element 12.

Experiments with this antenna have shown that the first and second elements 16, 17 are sufficient to provide the printed antenna with the classical doughnut shaped pattern that meets on the directional requirement of the antenna. The antenna pattern around the horizontal plane varies less than 2 dB. The peak of the pattern in the vertical plane lies between 20° and 30° above the azimuth. By end feeding the printed antenna minimises the radiation pattern distortion.

Figure 3:
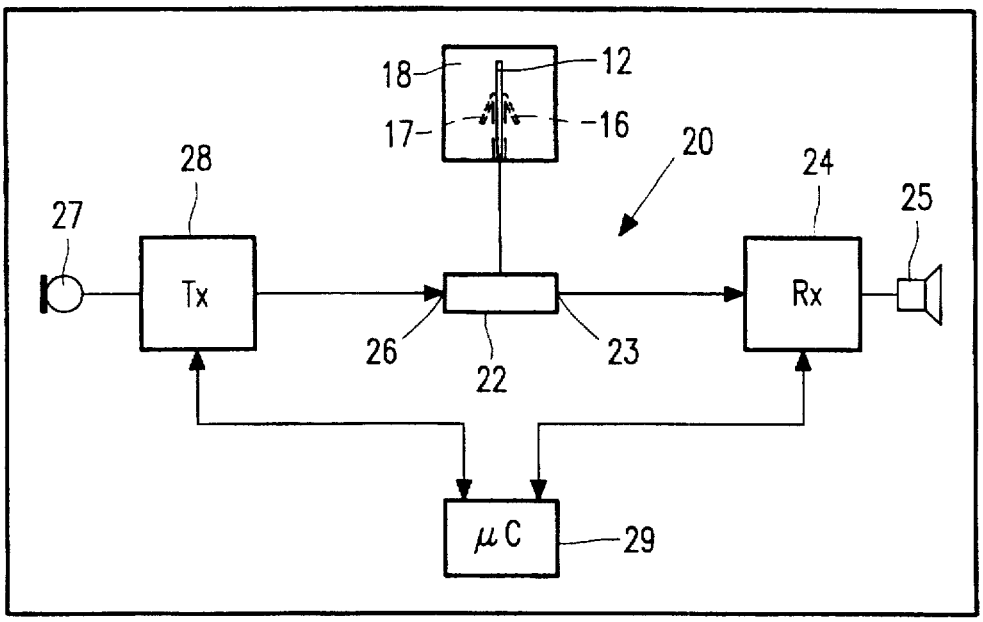
FIG. 3 is a block schematic diagram of a transceiver.

Referring to FIG. 3 the transceiver 20 comprises a printed antenna 18 of the type shown in FIGS. 1 and 2 connected by the end feed point to a diplexer 22 having an output 23 coupled to a receiver 24 which is connected to an output transducer 25. The diplexer 22 has an input 26 to which is connected a transmitter 28 to which is connected a microphone 27. A microcontroller 29 controls the operation of the receiver and transmitter.

Figure 4:
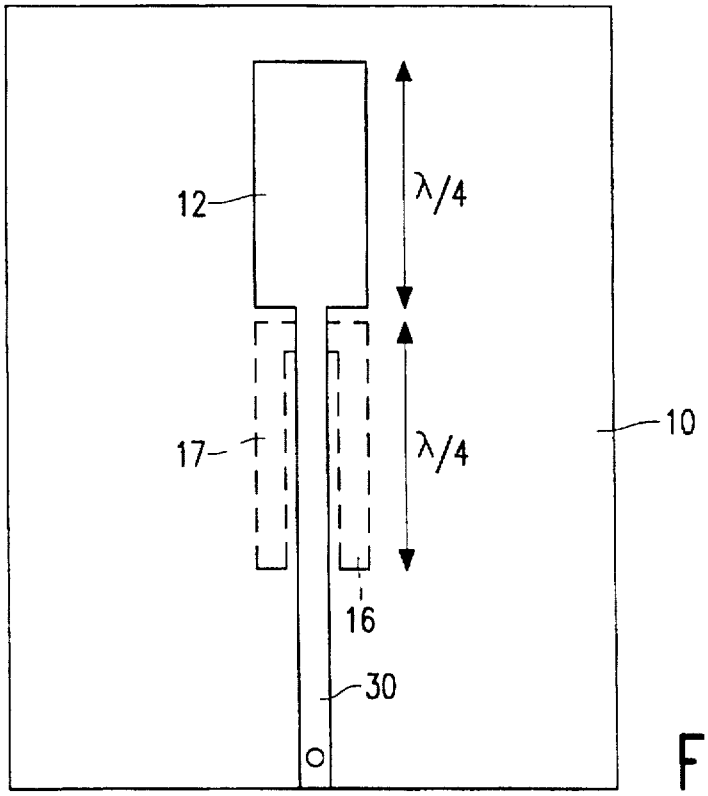
FIG. 4 is a diagram illustrating a second embodiment of the printed antenna made in accordance with the present invention having a printed sleeve dipole.

FIG. 4 illustrates a second embodiment of the printed antenna, certain features of which are the same as the first embodiment shown in FIGS. 1 and 2 and accordingly will not be described again. In this embodiment the feed 30 to the first dipole element 12 is narrower than the element. The feed to the second dipole element comprising the first and second elements 16, 17 is of the same width as the feed 30 and accordingly is not visible in FIG. 4. The first and second elements 16, 17 in this second embodiment extend downwardly, parallel to but not overlapping the feed thereto. More particularly the feed to the first and second dipoles consists of a parallel strip transmission line consisting of two equal width printed conductors arranged one on each side of the substrate 10. One of the feed lines is connected at the centre of the antenna to the parallel elements 16, 17. The other feed line, feed 30, on the other side of the circuit is extended to form the upper dipole element. For symmetry the width of the upper first dipole element 12 is greater than its feed 30 and has the same width as the overall distance between the first and second elements 16, 17. Overall this feed structure is narrower than that shown in FIGS. 1 and 2.

The antenna shown in FIG. 4 can be substituted for the antenna 18 in the transceiver shown in FIG. 3.

Figure 5:
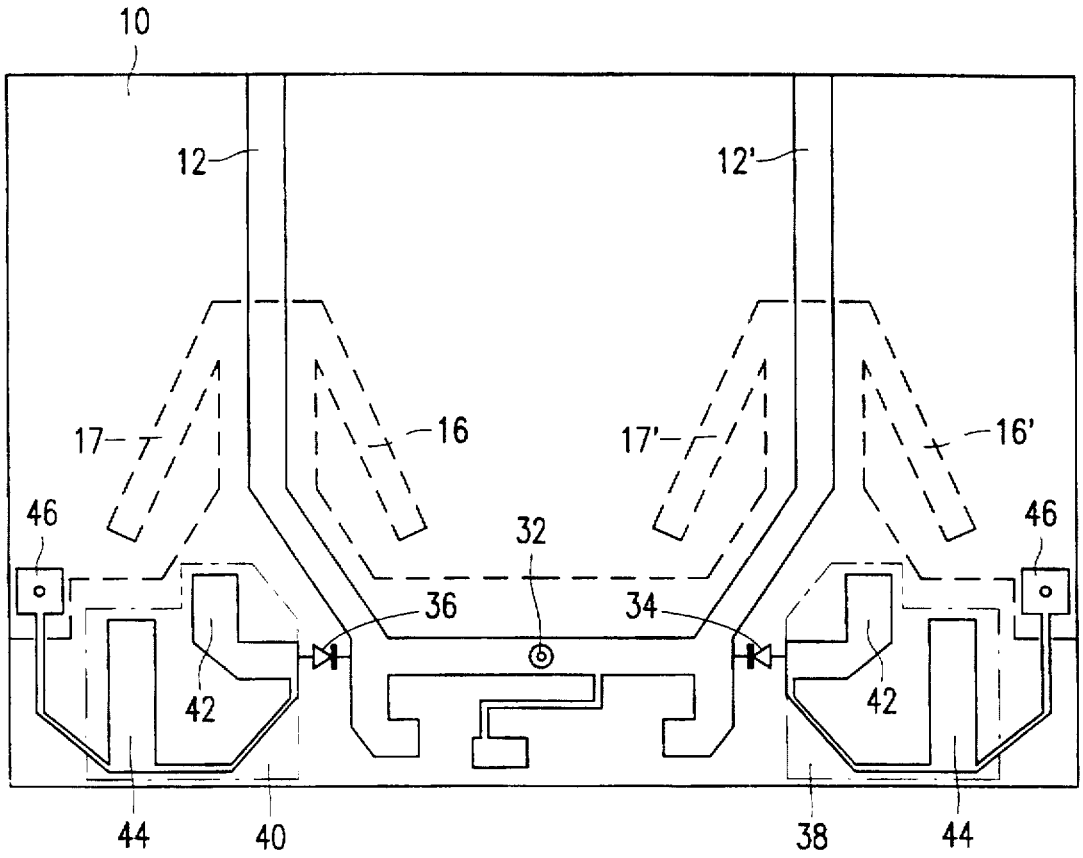
FIG. 5 is a diagram of an antenna diversity arrangement comprising two antennas of the type shown in FIG. 1 together with PIN diodes for switching between one or other of the antennas.

The antenna diversity arrangement shown in FIG. 5 comprises two printed antennas of the type shown in FIGS. 1 and 2. For ease of reference the dipole elements of the second antenna have been referenced 12', 16' and 17'. The antennas are laid out on the substrate 10 such that the first dipole elements 12, 12' are separated by a distance corresponding to substantially half a wavelength of the frequency (or centre frequency) of interest. The feed lines of these two dipole elements are of the same width as the dipoles and comprise a 50 ohm line. A common feed point 32 is provided at substantially the mid-point of this line. The first and second elements 16, 17 and 16', 17' of the second dipole are on the opposite side of the substate 10. PIN diodes 34, 36 are connected to the feed lines of the first dipole elements 12, 12' at a position remote from their main radiation region. These PIN diodes are also connected to respective low-pass filters 38, 40 comprising capacitive stubs 42, 44 which are coupled to terminals 46.

In a non-illustrated embodiment of the antenna diversity arrangement a distance of substantially a quarter of a wavelength of the frequency (or centre frequency) of interest between the first dipole elements 12, 12' has been found to give good results. Distances of between a quarter and a half wavelength will also provide beneficial results.

Figure 6:
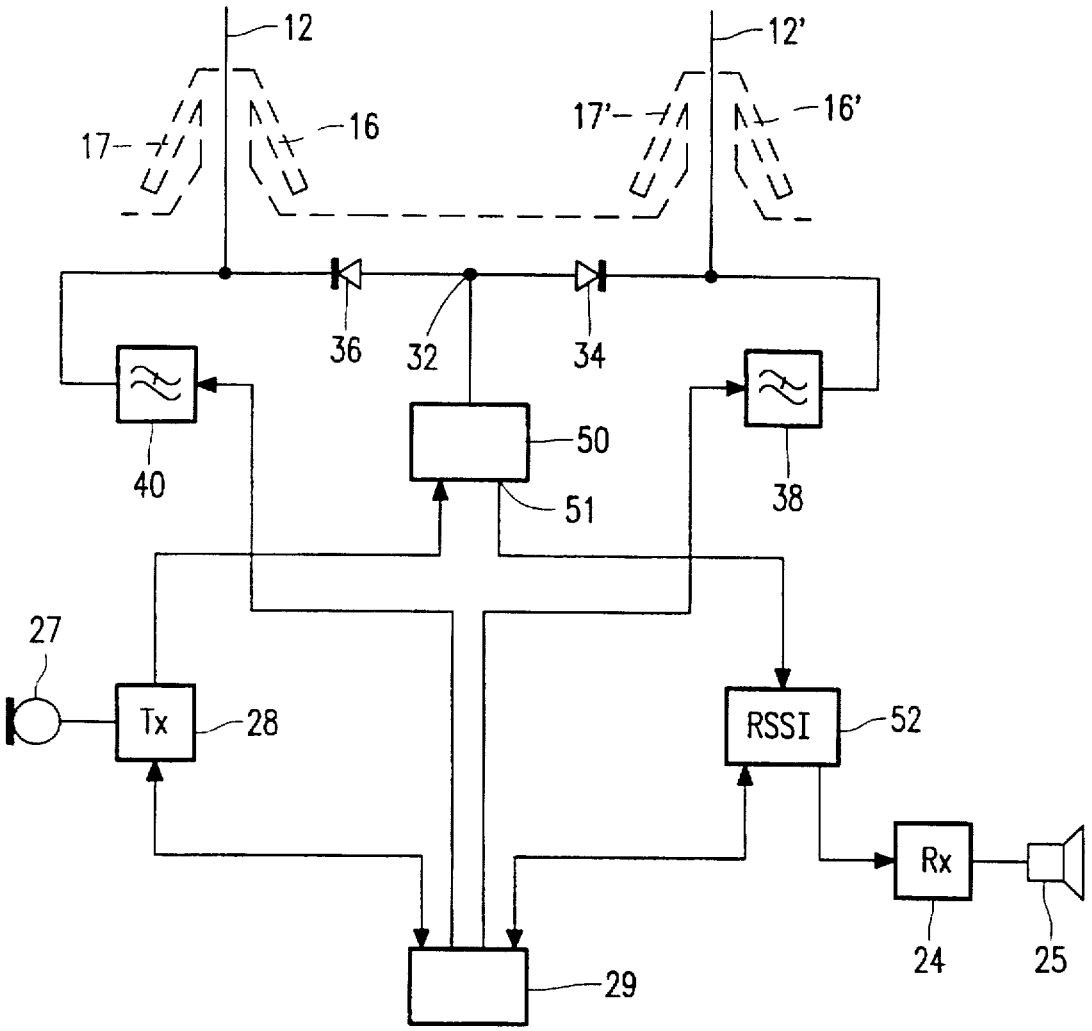
FIG. 6 is a block schematic diagram of a transceiver having the antenna diversity arrangement shown in FIG. 5.

The transceiver shown in FIG. 6 comprises the two antenna diversity arrangement shown in FIG. 5, the feed terminal of which is connected to a diplexer 50. A transmitter 28 is coupled to an input of the diplexer 50. An output 51 for a received signal is connected to means 52 for measuring the radio signal strength (RSSI) and to a radio receiver 20 for having an output transducer 25. The measured RSSIs are relayed to a microcontroller 29 which on determining that the received signal strength on one of the dipoles is dropping reverses the energisation of the PIN diodes 34, 36 such that the currently active antenna is shorted to ground and the other inactive antenna element is made operational and the signal strength is measured. If the RSSI is greater than that which was being received from the previously selected antenna then the new antenna remains selected. However, if it is not then the switching cycle is reversed and the previously active antenna is connected to the diplexer 50.

From reading the present disclosure, other modifications will be apparent to persons skilled in the art. Such modifications may involve other features which are already known in the design, manufacture and use of printed antennas and component parts thereof and which may be used instead of or in addition to features already described herein. Although claims have been formulated in this application to particular combinations of features, it should be understood that the scope of the disclosure of the present application also includes any novel feature or any novel combination of features disclosed herein either explicitly or implicitly or any generalisation thereof, whether or not it relates to the same invention as presently claimed in any claim and whether or not it mitigates any or all of the same technical problems as does the present invention. The applicants hereby give notice that new claims may be formulated to such features and/or combinations of such features during the prosecution of the present application or of any further application derived therefrom.

I claim:

1. A printed antenna comprising an end fed elongate first dipole element provided on one side of a dielectric substrate, said first dipole element having a portion acting as an antenna dipole and a feed portion, a second dipole element provided on a second side of the dielectric substrate, the second dipole comprising first and second elongate elements disposed one on each side of the longitudinal axis of the first dipole element as viewed through the substrate and a ground plane coextensive with only the feed portion of the first dipole element, said ground plane being connected to the first and second elements.

2. A printed antenna as claimed in claim 1, characterised in that the ground plane is connected to the first and second elements at a distance corresponding substantially to a quarter wavelength of the frequency of interest from a free end of the first dipole element and in that the lengths of the first and second elements correspond substantially to said distance.

3. A printed antenna as claimed in claim 1 or 2, characterised in that the first and second elements are parallel relative to each other.

4. A printed antenna as claimed in claim 1 or 2, characterised in that the first and second elements are inclined at an angle of between 10 and 45 degrees to the first dipole element.

5. A transceiver comprising a transmitter having an output, a receiver having an input, a printed antenna as claimed in any one of claims 1 or 2, means coupling said output and input to said printed antenna.

6. A printed antenna as claimed in claim 1 wherein said printed antenna includes no balun and is directly connectable to circuitry.

7. The combination of first and second parallel arranged printed antennas and switching means for shorting out a predetermined one of said first and second antennas, wherein each of said first and second antennas comprises an end fed elongate first dipole element provided on one side of a dielectric substrate, said first dipole element having a portion acting as an antenna dipole and a feed portion, a second dipole element provided on a second side of the dielectric substrate, the second dipole comprising first and second elongate elements disposed one on each side of the longitudinal axis of the first dipole element as viewed through the substrate and a ground plane coextensive with only the feed portion of the first dipole element, said ground plane being connected to the first and second elements.

8. The combination as claimed in claim 7, characterised in that the elongate first dipole elements of said first and second antennas are spaced apart by a distance of between substantially a quarter and half the wavelength of the frequency of interest.

9. The combination as claimed in claim 7 or 8, characterised in that the ground plane of each of the first and second antennas is connected to the first and second elements at a distance corresponding substantially to a quarter wavelength of the frequency of interest from a free end of the first element and in that the lengths of the first and second elements correspond substantially to said distance.

10. The combination as claimed in claim 7 or 8, characterised in that the first and second elements are inclined at an angle of between 10 and 45 degrees to the first dipole element.

11. A transceiver comprising a transmitter having an output, a receiver having an input, the combination of first and second printed antennas as claimed in any one of claims 7 or 8, means coupling said output and input to said first and second printed antennas and means for actuating said switching means.

12. The combination as claimed in claim 7 wherein said first and second printed antennas include no balun and are directly connected to the switching means.

* * * * *